US005953845A

United States Patent [19]

Longwitz

[11] Patent Number: 5,953,845

[45] Date of Patent: Sep. 21, 1999

[54] QUICK-LOADING DEVICE FOR A REVOLVER

[75] Inventor: Gerhard Longwitz, Neckarbischofsheim, Germany

[73] Assignee: Longwitz Schiesssportechnik GmbH, Germany

[21] Appl. No.: 08/930,736

[22] PCT Filed: Mar. 27, 1996

[86] PCT No.: PCT/DE96/00531

§ 371 Date: Oct. 3, 1997

§ 102(e) Date: Oct. 3, 1997

[87] PCT Pub. No.: WO96/31751

PCT Pub. Date: Oct. 10, 1996

[30] Foreign Application Priority Data

Apr. 5, 1995 [DE] Germany ..... 195 12 632

[51] Int. Cl.[6] ..... F41A 9/61

[52] U.S. Cl. ..... 42/89

[58] Field of Search ..... 42/89

[56] References Cited

U.S. PATENT DOCUMENTS

| | | | |
|---|---|---|---|
| 2,944,359 | 11/1960 | Hanley | 42/89 |
| 3,150,459 | 9/1964 | Schoick . | |
| 3,197,907 | 8/1965 | Olson | 42/89 |
| 3,252,238 | 5/1966 | Bye | 42/89 |
| 3,503,150 | 3/1970 | Brunhuber et al. . | |
| 3,541,716 | 11/1970 | Fordham et al. | 42/89 |
| 3,722,125 | 3/1973 | Switzer | 42/89 |
| 3,769,732 | 11/1973 | Griffis | 42/89 |
| 4,202,124 | 5/1980 | Switzer . | |
| 4,272,903 | 6/1981 | Griffis | 42/89 |
| 4,313,275 | 2/1982 | Switzer | 42/89 |
| 4,796,371 | 1/1989 | Daniels | 42/89 |
| 4,866,870 | 9/1989 | Johnson . | |

FOREIGN PATENT DOCUMENTS

| | | |
|---|---|---|
| 9320984 | 8/1993 | Germany . |

*Primary Examiner*—Charles T. Jordan
*Assistant Examiner*—Chris J. Brown
*Attorney, Agent, or Firm*—Galgano & Burke

[57] ABSTRACT

The quick-loading device proposed has a cartridge holder which holds cartridges in such a way that they can be inserted simultaneously into the chambers of the revolving cylinder and released from the holder. The cartridge holder can be adjusted so that the positions of the cartridges in it can be changed, preferably in synchronized fashion, and thus adapted to the different types of revolver. The quick-loading device proposed can be secured to prevent the cartridges in it from being released.

40 Claims, 8 Drawing Sheets

QUICK-LOADING DEVICE FOR A REVOLVER

BACKGROUND OF THE INVENTION

The invention relates to a quick-loading device for a revolver with a cartridge holder, which receives cartridges in such a way that they can be simultaneously inserted into the chambers of a revolver cylinder and released from the holder.

Such a quick-loading device was developed by William de Courcy Prideaux in 1893. It has a collar of leaf-type holding springs, between which the cartridges are seated in an arrangement matching the chamber collar of a revolver cylinder. The quick-loading device is capable of dispensing the cartridges simultaneously into the chambers of a revolver cylinder, provided such cylinder is accessible therefor. This is the case in standard revolvers with pivoted barrel or with cylinder that can be swung out sideways.

The known revolver models comprise a range of chamber collar diameters. Heretofore a separate quick-loading device has been necessary for each chamber collar diameter.

SUMMARY OF THE INVENTION

The object of the invention is to provide a quick-loading device of the type mentioned in the introduction which is suitable for a plurality of revolver models comprising a range of chamber collar diameters.

The quick-loading device that achieves this object has an adjustable cartridge holder, with which the position of the held cartridges can be preferably synchronously changed and adapted to the different chamber collar diameters of a plurality of revolver models.

In a preferred embodiment, the radial position and/or radial inclination of the cartridges contained in the cartridge holder is changed during adjustment.

In a preferred embodiment, the cartridges in the cartridge holder occupy a basic position parallel to the direction of insertion into the revolver cylinder. Relative to this basic position, the cartridges can be varied inwardly and outwardly and fixed as preferred in their radial position and/or radial inclination during adjustment.

In a preferred embodiment, the quick-loading device has a housing with a collar of receiving holes for the cartridges. Each cartridge is held in the receiving hole by a hook that engages with the cartridge rim and bears on the cartridge case. The radial position and/or radial inclination of the hooks and thus of the cartridges can be varied and fixed preferably synchronously during adjustment.

Heretofore the cartridge rim has been sharp-edged. Preferably, therefore, the hook or at least the hook portion engaging with the cartridge rim consists of wear-resistant plastic or hard metal or, to counteract wear of the hook, is provided with a facing of hard metal.

The hook portion bearing on the cartridge case preferably has a channel into which the cartridge fits. As a result, the cartridges are properly positioned on the hooks and their adjustment is correspondingly precise.

In a preferred embodiment, the hooks while in holding position rest on a ramp. Adjustment takes place by positioning the hooks along the ramp or by positioning the ramp along the hooks.

Preferably the hooks are held against the ramp by springs.

In a preferred embodiment, the hooks are disengaged from the cartridge rim and the cartridges are released by positioning the hooks along the ramp or by positioning the ramp along the hooks. Thereby there is achieved a combined adjustment and release mechanism of simple construction.

In a preferred embodiment, the ramp has one gently inclined portion and one steep portion. Adjustment of the hooks takes place on the gently inclined ramp portion and disengagement of the hooks on the steep ramp portion. Thereby sensitive adjustment and prompt release of the cartridges is assured.

In a preferred embodiment, the hooks hold the cartridges at the radially inward side. The ramps are disposed on the radially inward side of the hooks. Inside the ramp collar there is provided a ram, which during loading impinges on the axis of the revolver cylinder and drives into the housing to release the cartridges.

In a preferred embodiment the ramps are disposed integrally with the housing, and in particular are secured against rotation in the housing. As the ram drives into the housing, it also drags along the hooks and if applicable a guide ring holding the hooks.

In a preferred embodiment, the hooks are braced against the rear end of the ram. The hooks can be adjusted by adapting the ram length.

In a preferred embodiment, the ram comprises a threaded bushing which is held in such a way that it is secured against rotation relative to the housing but is axially positionable therealong and which is structurally united if applicable with the guide ring, an adjusting screw which is screwed into the threaded bushing and against which the hooks are braced, and a locking arrangement for the adjusting screw. The said locking arrangement can be a locking screw screwed into the threaded bushing, thus jamming the adjusting screw, or a polygonal guide for the adjusting screw. Other possibilities for the locking arrangement are a hard-to-turn thread such as obtained with a metal-plastic material combination or the use of adhesive.

In a preferred embodiment, the cartridge receiving holes are provided on the side opposite the hook with a radiused pocket. In this case the cartridges are held on the one hand with the cartridge rim in the radiused pocket and on the other hand with the hook.

For safety reasons, the quick-loading device according to the invention can be locked to prevent it from dispensing cartridges. A self-contained guard independent of the adjustment capability of the cartridges is used for this purpose. In a preferred embodiment, the driving-in movement of the ram is blocked or released with a positionable stop operated by lock and key.

BRIEF DESCRIPTION OF THE DRAWINGS

The invention will be explained in more detail hereinafter by reference to two practical examples illustrated in the drawing, wherein:

FIG. 2 shows the stock of the quick-loading device at the left side of FIG. 1;

FIG. 3 shows the cartridge-holding mechanism of the quick-loading device, partly in longitudinal section;

FIG. 4 shows the housing ring of the quick-loading device at the right side of FIG. 1, in the section through IV—IV of FIG. 6;

DETAILED DESCRIPTION OF THE PREFERRED AND ILLUSTRATED EMBODIMENTS

Figure 1:
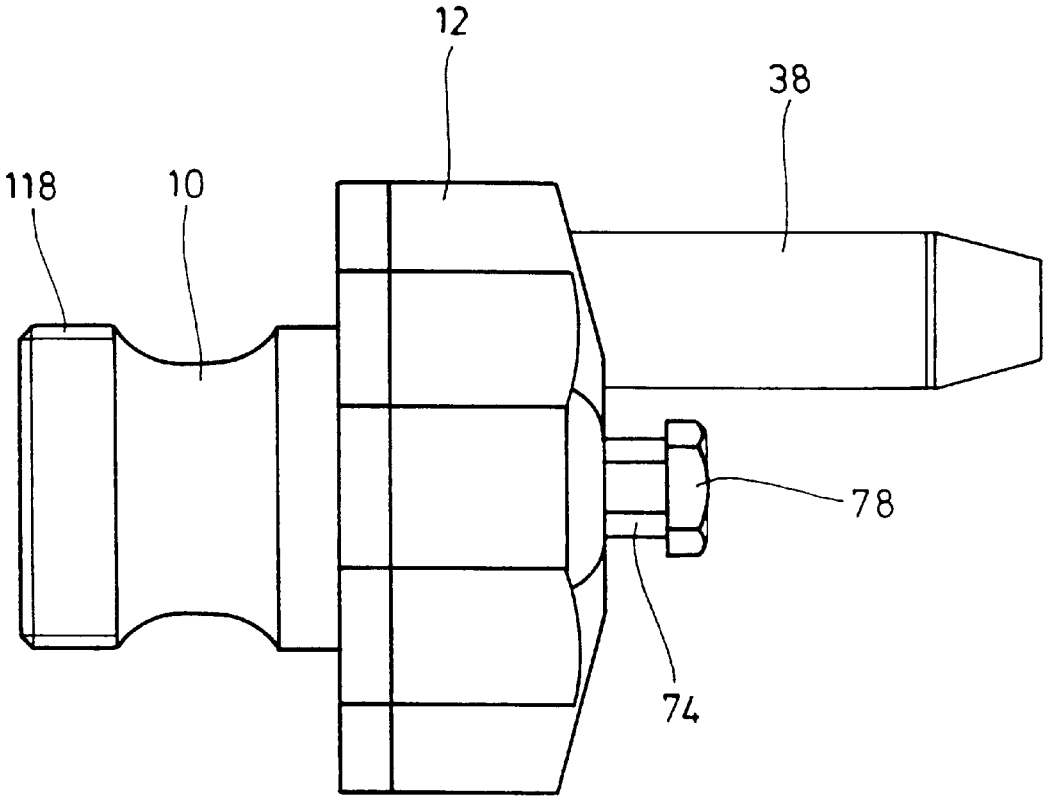
FIG. 1 shows a side view of a first quick-loading device.
Figure 2:
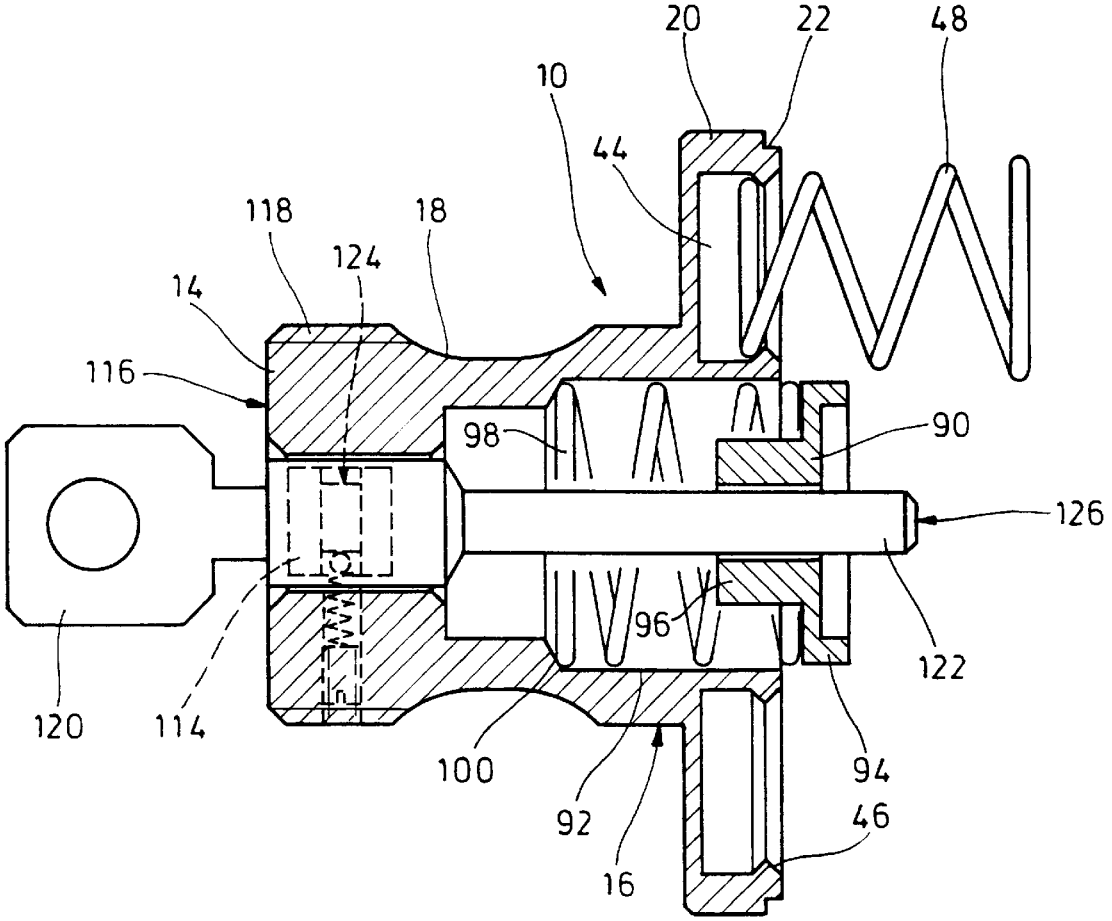
FIGS. 2 to 4 show exploded diagrams of this quick-loading device in side view; and specifically
Figure 3:
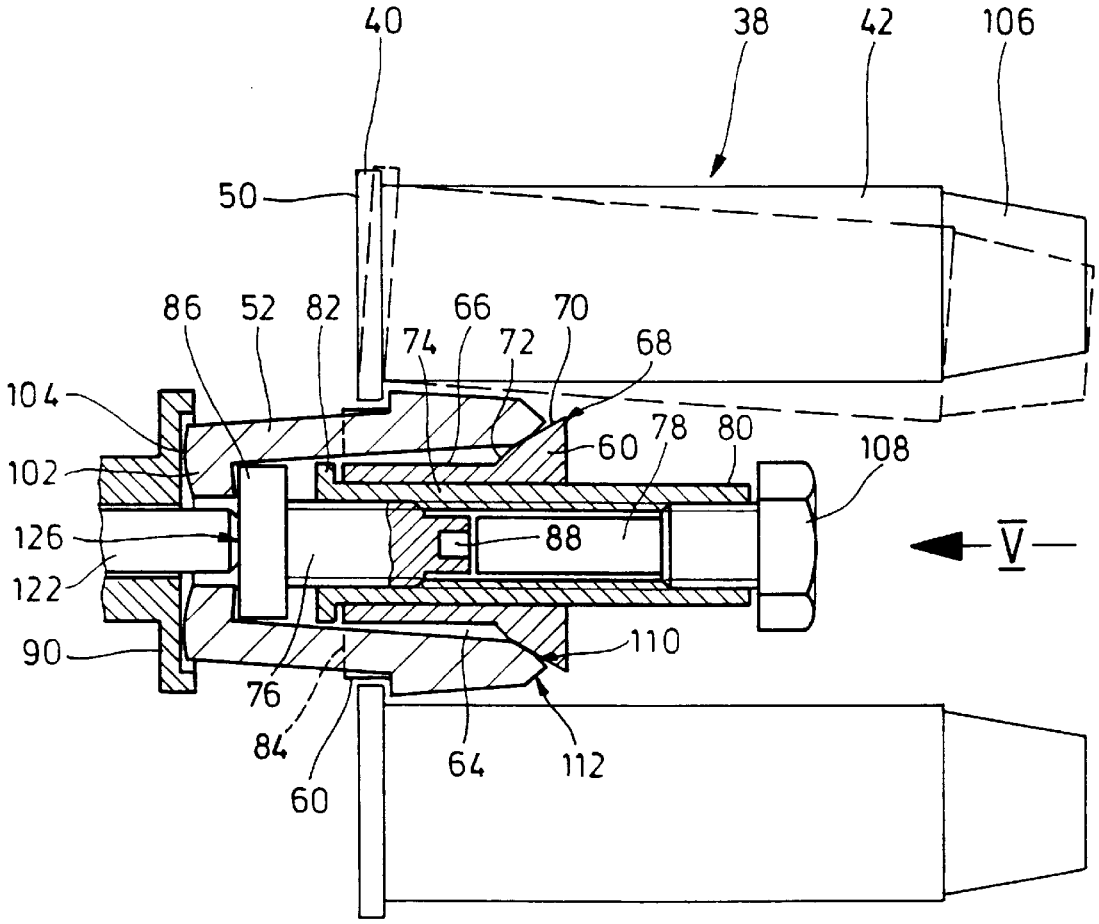

The quick-loading device according to FIG. 1 to FIG. 11 has a housing comprising a stock 10 and a front housing ring 12 thereon. The stock 10 is a hollow member. It has a substantially cylindrical knob 14, which is provided at its outer shell 16 with a waist-shaped section 18.

The rear end of the knob 14 is provided with a male thread 118, which imparts gripping roughness and permits an extension to be screwed on.

At its front end, the knob 14 merges into an annular plate 20, which extends radially outward in the form of a flange. At the outer rim of its front end, the annular plate 20 has a diameter step-down 22, on which there fits the housing ring 12 with complementary bore 24. The stock 10 and housing ring 12 are bolted together at two diametrically opposite points 26.

The housing ring 12 has a central opening 28 and therearound a concentric collar of cartridge receiving holes 30. The central opening 28 has a guide hexagon 32 in the front wall 34 of the housing ring 12 and therebehind a cylindrical portion 36 of larger diameter.

The cartridge receiving holes 30 are cylindrical and pass axially through the housing ring 12. Each has slightly oversize diameter, thus allowing the cartridge rim 40 encircling a cartridge 38 to fit therein with some freedom of movement. The cartridge rim 40 projects radially outward beyond the cartridge case 42. Thereby the cartridges 38 with cartridge cases 42 have freedom of inclination in the cartridge receiving holes 30.

The annular plate 20 of the stock 10 has a collar of spring nests 44, which line up axially with the cartridge receiving holes 30. The spring nests 44 are blind holes. Close to their front opening they have wards 46 distributed over the circumference, to permit conical helical compression springs 48 to be screwed into the spring nests 44. The helical compression springs 48 project axially forward beyond the annular plate 20 and are held at the wards 46. They press on the bottom 50 of the cartridges 38 seated in the cartridge receiving holes 30, in order to eject them from the cartridge receiving holes 30.

The cartridges 38 are held by hooks 52 in the cartridge receiving holes 30. The cartridge receiving holes 30 are slotted on the radially inward side, to permit engagement of the hooks 42 with the cartridges 38. The hooks 52 protrude with their front portion through the slot of the cartridge receiving holes 30 and engage with the front of the cartridge rim 40.

The hooks 52 according to FIG. 7 to FIG. 11 consist of plastic. In view of the resilience of the plastic material, they have a somewhat angular and sharp-edged shape. The portion of the hooks 52 engaging with the cartridge rim 40 is provided with a facing 54 in the form of a sheet-metal strip, the profile of which matches the hook contour. At the ends, the sheet-metal strip has bent-over pins 56, with which it is anchored in the plastic body of the hook 52. The sheet-metal strip is a one-piece stamping. It consists of steel, or in other words a metal harder than the brass normally used for cartridge cases 42.

Figure 5:
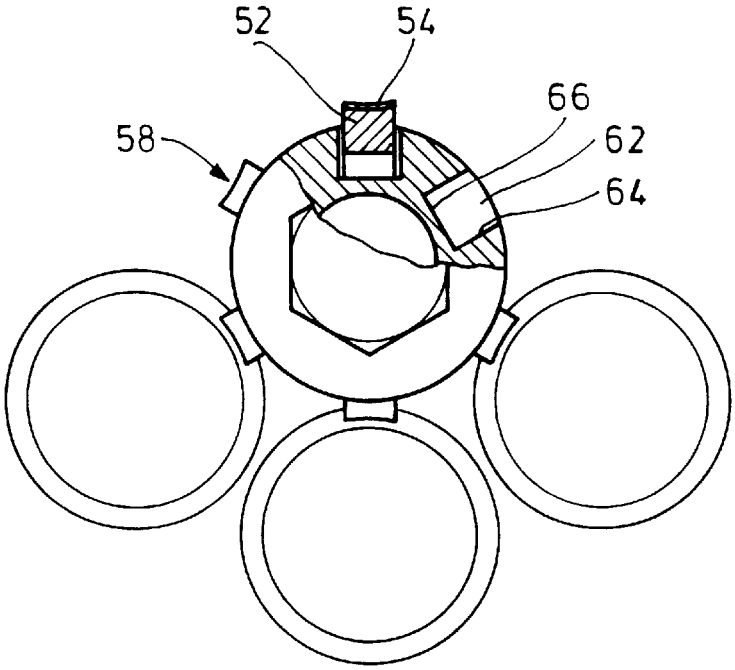
FIG. 5 shows an axial front view of parts of the cartridge-holding mechanism, viewed in direction V of FIG. 3.

The portion of the hook 52 acting against the cartridge case 42 is provided externally with a cylindrical channel 58, into which the cartridge 38 fits snugly (see FIG. 5). The facing 54 has a corresponding channel 128 (see FIG. 11).

In the middle, the hooks 52 are held on a substantially cylindrical guide ring 60. The guide ring 60 is press-fitted coaxially in the larger-diameter cylindrical portion 36 of the central opening 28 in the housing ring 12, thus occupying a fixed position in the housing of the quick-loading device.

Longitudinal grooves 62, each receiving one hook 52, are distributed at equal spacings over the circumference of the guide ring 60. During their engagement and disengagement movement at the cartridge rim 40, the hooks 52 are guided in the longitudinal grooves 62.

The longitudinal grooves 62 are rectangular in cross section, and with their side walls 64 are radially oriented. Their bottom 66 slopes backward in the form of a ramp from the front outside rim 68 of the guide ring 60. Behind the ramp the groove bottom 66 becomes parallel to the axis and flat.

The ramp is inclined gently with an angle of about 30° at the front and more steeply with an angle of about 45° at the rear. In holding position, the front ends of the hooks 52 bear on the gently inclined 30° ramp portion 70. To release the cartridges 38, the hooks 52 are moved along the steep 45° ramp portion 72 in inward direction.

In the cylindrical opening of the guide ring 60 there is guided a ram, which during loading of the revolver impinges on the cylinder axis, drives into the housing of the quick-loading device and drags the hooks 52 down the steep 45° ramp portion 72. By adapting the length of the ram, the hooks 52 can be adjusted to holding position on the gently inclined 30° ramp portion 70. The ram consists of a cylindrical threaded bushing 74 with female thread, an adjusting screw 76 and a locking screw 78, both of which are screwed into the threaded bushing 74.

The threaded bushing 74 is guided axially movably in the cylindrical opening of the guide ring 60. At the front it protrudes from the guide ring 60, and here it is provided with a male hexagon 80, which fits into the hexagonal opening 32 of the housing ring 12. Thereby the threaded bushing 74 is secured against rotation relative to the housing.

Obviously the threaded bushing 74 can also be secured against rotation relative to the housing by means of any other polygonal guide, flat section or similar means.

At the rear end, the threaded bushing 74 has a radially outwardly extending stop shoulder 82, with which it is braced against the rear end face 84 of the guide ring 60.

The adjusting screw 76, which at the rear end has a cylindrical head 86, is screwed into the rear of the threaded bushing 74.

At the front end of the shank of the adjusting screw 76 there is provided at the point a nonround structure such as a slot 88 or a hexagon in which a driving tool can be engaged. The adjusting screw 76 is turned from the front in order to move through the threaded bushing 74, which is prevented by its hexagon 80 from turning together with the adjusting screw. The adjusting screw 76 can be backed out to extend as far as is desired from the rear of the threaded bushing 74.

The locking screw 78 is screwed into the threaded bushing 74 from the front. In the practical example according to FIG. 1 to FIG. 11, the locking screw 78 is a cap screw, but a headless screw (not shown) can also be used as the locking screw 78. By tightening the locking screw 78 against the adjusting screw 76, the said adjusting screw is jammed and locked in the desired backed-out length from the threaded bushing 74.

The hooks 52 protrude with their rear end from the guide ring 60. They are braced against the face of a spring plate 90, which is guided axially movably in the cylindrical opening 92 of the stock 10. The spring plate 90 has a cylindrical annular member with a forwardly pointing guide shoulder 94 of larger diameter which encircles the hooks 52, and a rearwardly pointing guide shoulder 96 of smaller diameter on which there is seated a helical compression spring 98. The helical compression spring 98 is braced against a diameter step 100 of the cylindrical opening 92 and presses the spring plate 90 in the forward direction.

At the rear, the hooks 52 are held against the cylindrical head 86 of the adjusting screw 76, but have some freedom of inclination. The said hooks have radially inwardly directed projections 102, which protrude behind the cylindrical head 86 and form a pivot bearing that allows the hooks 52 to swivel in radial planes. The contact surface 104 of the hooks 52 against the spring plate 90 is chamfered or rounded, so that the force of the helical compression springs 98 is transmitted radially outwardly from the pivot bearing to the hooks 52.

The hooks 52 are pressed against the ramps with a preload force that tends to make them swivel into the longitudinal grooves 62 and release the cartridges 38. At the same time, the ram is pushed with preload force exerted by the helical compression spring 98 into its retracted position, and with the stop shoulder 82 of the threaded bush 74 is caught against the guide ring 60.

By adapting the length of the ram, the cartridge holding position of the hooks 52 on the gently inclined 30° ramp portion 70 can be influenced to the effect that the hooks 52 and the cartridges 38 resting in the channels 58 thereof are commensurately displaced and inclined in radial direction. The diameter oversize of the cartridge receiving holes 30 and the diameter step-down of the cartridge cases 42 relative to the cartridge rim 40 allows the cartridges 38 the necessary freedom of movement to do so in the cartridge receiving holes 30. By adapting the length of the ram, the quick-loading device is adjusted such that the cartridge tips 106 become positioned exactly in front of the chambers of the revolver cylinder. In this way the quick-loading device can be adapted to the different chamber collar diameters of a plurality of revolver models.

For this adjustment process, the locking screw 78 is backed out of the threaded bushing 74, which itself is secured against rotation. The adjusting screw 76 is turned with a driving tool inserted into the threaded bushing 74 and is backed out to the desired extent from the threaded bushing 74. The ends of the hooks 52 move radially inward or radially outward on the gently inclined 30° ramp portion 70 depending on whether a process of backing out of or screwing into the threaded bushing 74 is being carried out. The cartridges 38 resting in the channels 58 of the hooks 52 are adjusted in accordance with the displacement and inclination of the hooks 52. In the desired position of the cartridges 38 adapted to the respective chamber collar diameter, locking action is provided by tightening the locking screw 78 against the adjusting screw 76.

During loading, the head 108 of the locking screw 78 located at the front end of the ram impinges on the axis of the revolver cylinder. The ram drives into the housing of the quick-loading device, dragging along the hooks 52 caught on the cylindrical head 86 of the adjusting screw 76. The front ends of the said hooks slide downward along the steep 45° ramp portion 72. The hooks 52 swivel into the longitudinal grooves 62, thus disengaging from the cartridge rim 40 and releasing the cartridges 38, which are ejected into the revolver cylinder by the helical compression springs 48 seated in the spring nests 44.

The front ends of the plastic hooks 52 have at the front an internal 45° chamfer 110, which is complementary to the steep 45° ramp portion 72. An external 45° chamfer 112 on the front end of the hooks allows the hooks 52 to be deflected rearwardly and radially inwardly against the force of the helical compression spring 98 in order to fill the quick-loading device with cartridges.

Once the quick-loading device has been filled with cartridges 38, the ram is positioned inaccessibly inside the cartridge collar, thereby preventing inadvertent release of cartridges 38. A hard implement, especially a tool such as a screwdriver, is needed to press down the ram and retrieve the cartridges 38 from the quick-loading device.

The quick-loading device can be secured to prevent dispensing of cartridges 38 therefrom. A self-contained guard independent of the adjustment capability of the cartridges 38 is used for this purpose.

In the knob 14 of the stock 10 there is machined a lock 114, which is accessible from the rear end 116 of the knob 14. A cover that overlaps the lock 114 can be screwed onto the male thread 118 of the knob 14. The lock 114 is operated with a key 120.

The cylinder of the lock 114 coacts with a rod 122, which extends centrally and axially through the stock 10, the spring plate 90 and the helical compression spring 98. The rod 122 is positioned in axial direction by turning the lock cylinder, whereupon the said rod is screwed forward by means of a thread or by following a cam 124. The front end 126 of the rod 122 forms a stop for the ram driving into the housing of the quick-loading device.

In the locked condition, the driving-in movement of the ram to release the cartridges 38 is blocked by the fact that the ram impinges on the end 126 of the rod 122. In the unlocked condition, the rod 122 is positioned sufficiently to the rear that it does not prevent the driving-in movement of the ram and release of the cartridges 38.

In the absence of the described locking option, a nonround structure such as a slot or a hexagon for engagement of a driving tool can be provided at the inner end of the ram. The ram can then be turned into position both from the front and also via a rear opening (not shown) for adjustment purposes.

Figure 12:
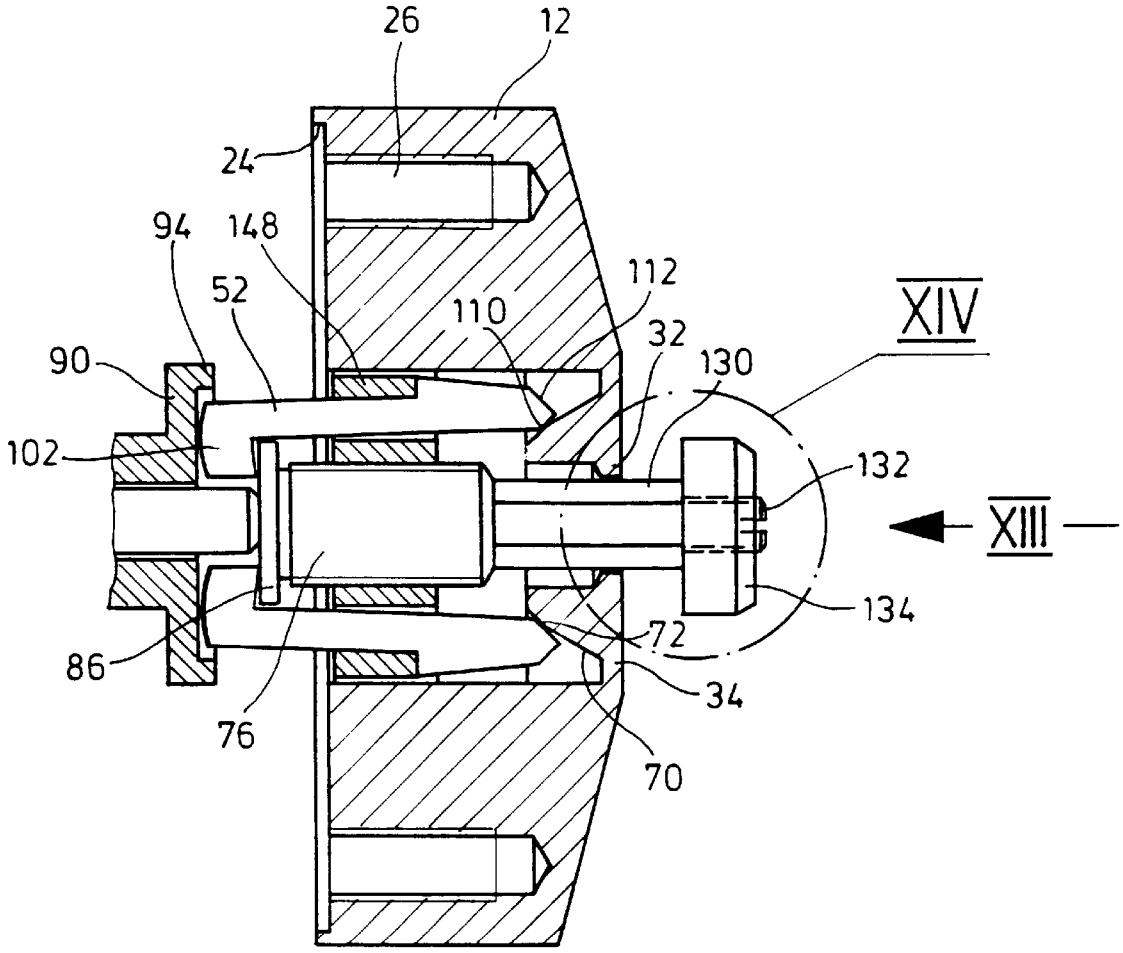
FIG. 12 shows the housing ring and cartridge-holding mechanism of a second quick-loading device, partly in longitudinal section.
Figure 13:
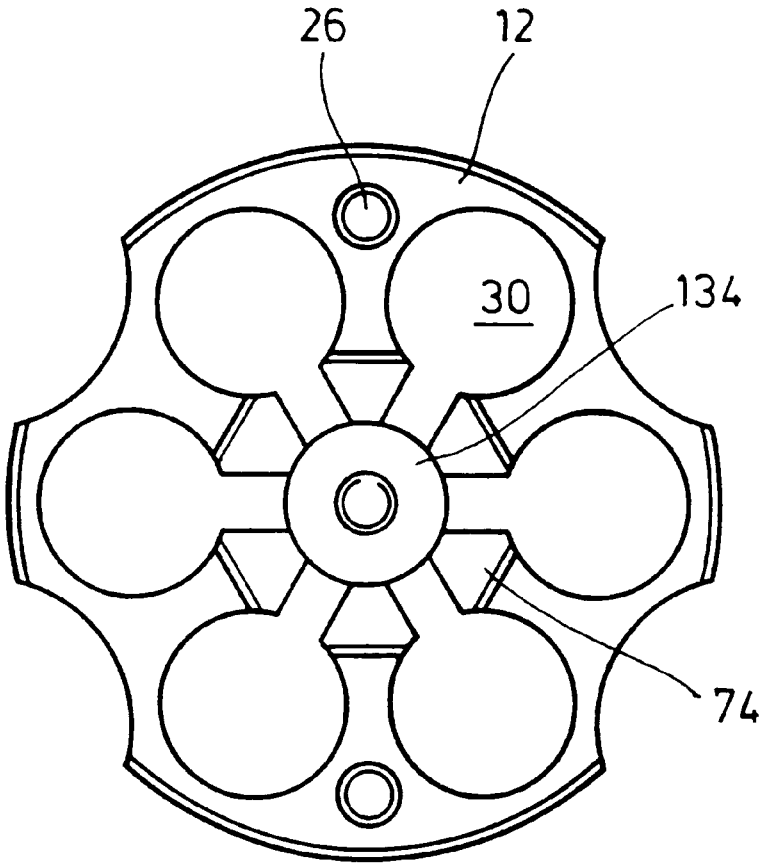
FIG. 13 shows an axial front view of the same, viewed in direction XIII of FIG. 12.
Figure 14:
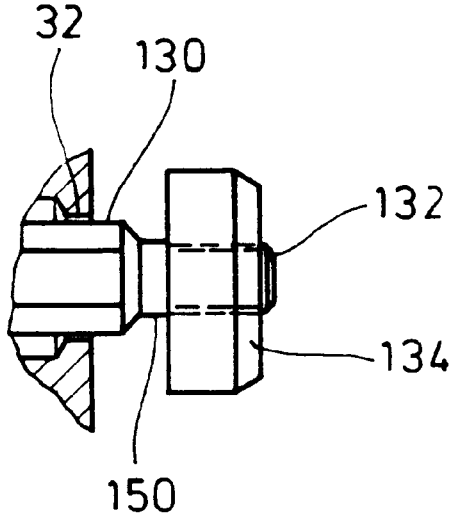
FIG. 14 shows a modified detail XIV of FIG. 13.

FIG. 12 to FIG. 14 show a modified embodiment of the quick-loading device. Like parts are denoted by like reference symbols, and the foregoing descriptions apply largely analogously.

In the quick-loading device according to FIG. 12 to FIG. 14, the ramps are provided on the housing ring 12. The threaded bushing is structurally united with the guide ring for the hooks 52, the said guide ring in turn being separated from the ramps. The structural union comprises a polygon 148, especially a twelve-sided or eighteen-sided polygon, which fits in the housing ring 12 in such a way that it is secured against rotation but is axially movable. Longitudinal grooves 62 for the hooks 52 are provided in every second or third external face of the polygon 148. The other external faces provide guidance.

The adjusting screw 76 is screwed into the central female thread of the polygon 148. As an extension of its shank, it is provided at the front end with an external hexagon 130, which fits into the hexagonal socket 32 of the housing ring 12.

A knurled nut 134 to limit the distance of travel into the housing is screwed onto a threaded stub 132 at the front end of the adjusting screw 76.

In the variant according to FIG. 12, the nut 134 is screwed off to permit adjustment. By means of a screwdriver engaged in the slot 88, the adjusting screw 76 is driven sufficiently far into the housing that the external hexagon 130 is clear of the hexagonal socket 32 of the housing ring 12. The adjusting screw 76 can now be turned and positioned in angular steps of 60°. Once the desired cartridge position has been located, the external hexagon 130 can be driven sufficiently far back into the hexagonal socket 32 that the adjusting screw 76 is locked against inadvertent displacement. Finally, the nut 134 used as the housing stop is screwed back onto the adjusting screw 76.

In the variant according to FIG. 14, the knurled nut 134 in the screwed-on condition is bonded with the threaded stub 132. The external hexagon 130 is provided behind the nut 134 with a relief 150, which has freedom to turn when the ram is driven into the guide hexagon 32. Adjustment by turning is therefore achieved with the knurled nut 134, without the need for a screwdriver. To facilitate retraction to the position secured against rotation, the edges of the external hexagon 130 are rounded.

Of course, any other desired polygonal guide can be used instead of a hexagonal guide for locking the adjusting screw 76.

During loading, the polygon 148 together with the hooks 52 is driven backward by impingement of the adjusting screw 76 on the axis of the revolver cylinder, and so the hooks 52 move inwardly on the ramps integral with the housing and disengage from the cartridge rim 40.

Figure 4:
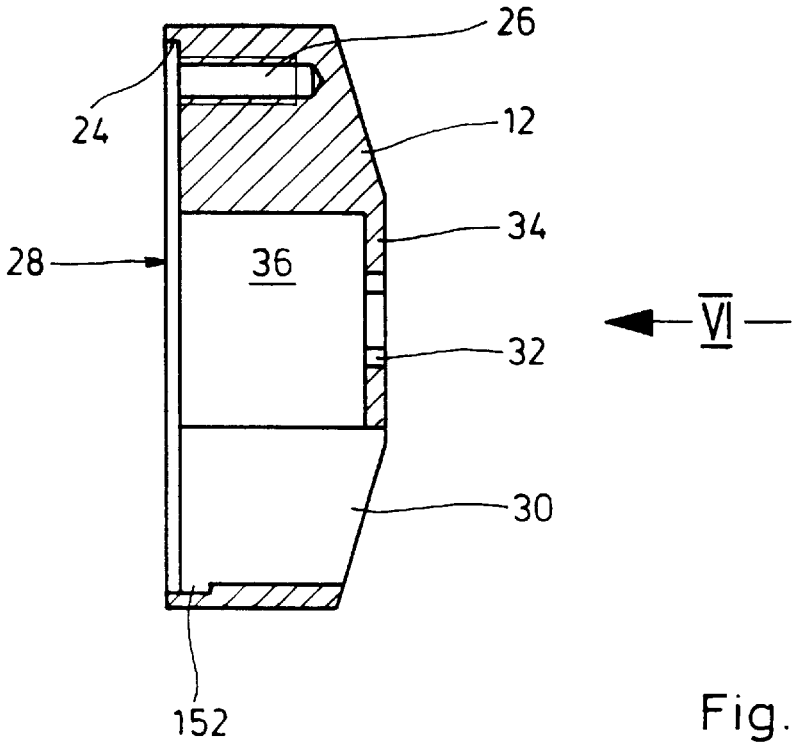
Figure 6:
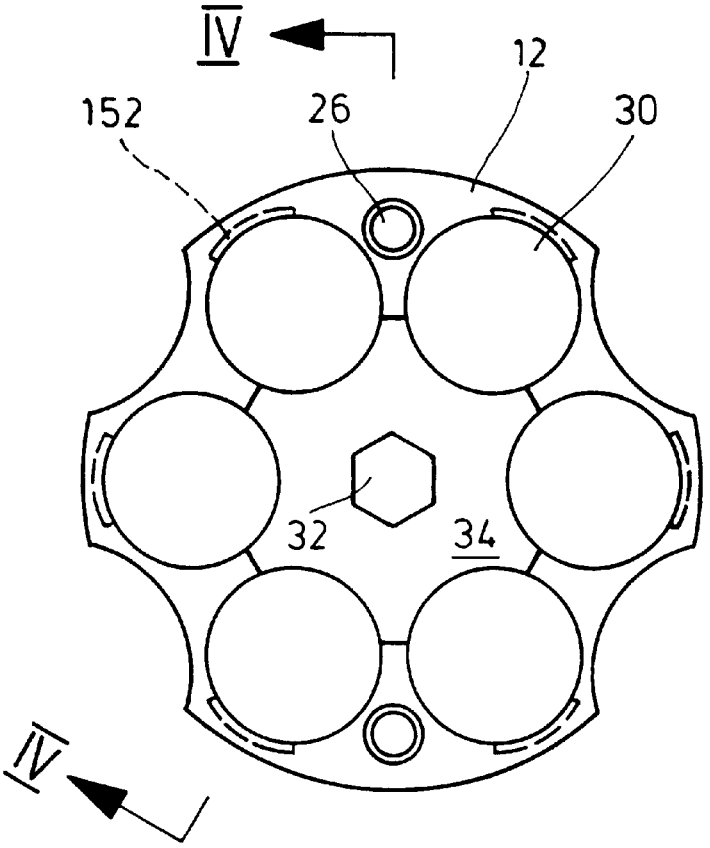
FIG. 6 shows an axial front view of the housing ring, viewed in direction VI of FIG. 4.
Figure 7:
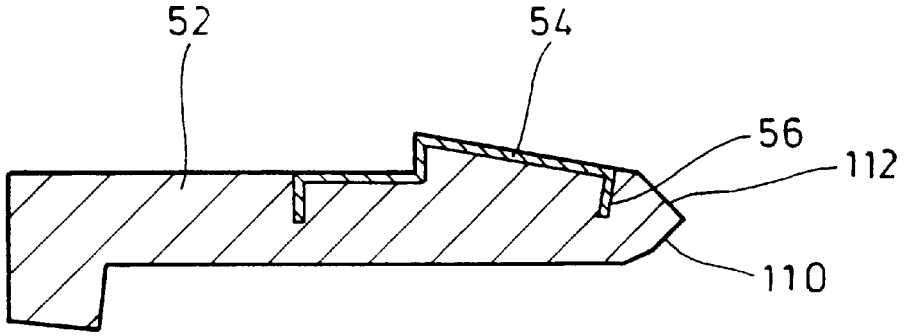
FIG. 7 shows a longitudinal section through a hook belonging to the cartridge-holding mechanism and consisting of plastic with metal facing.
Figure 8:
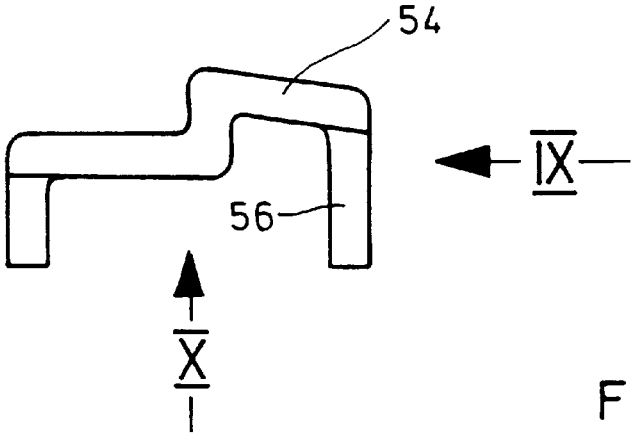
FIG. 8 shows a side view of the facing.
Figure 9:
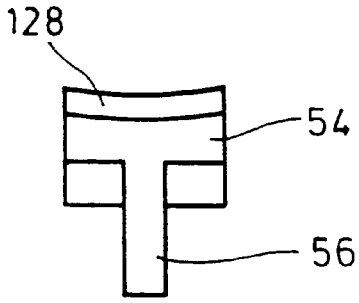
FIG. 9 shows a front view of the facing, viewed in direction IX of FIG. 8.
Figure 10:
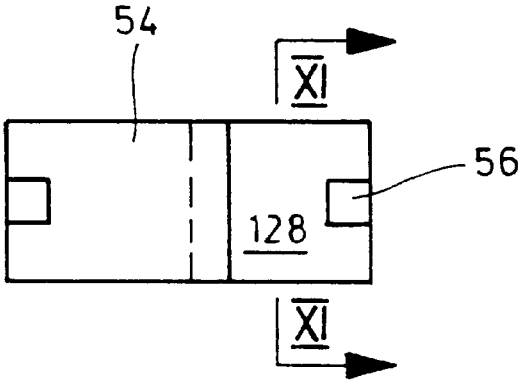
FIG. 10 shows a view of the underside of the facing in direction X of FIG. 8.
Figure 11:
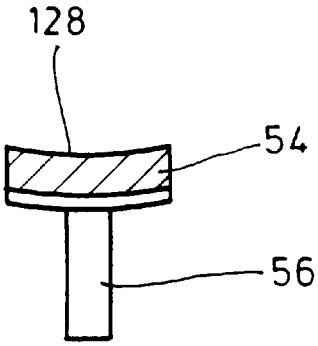
FIG. 11 shows a section through the facing along XI—XI of FIG. 10.

In blank cartridges and rimfire cartridges, the cartridge rim 40 is rounded, in contrast to sharp-edged centerfire ammunition. Heretofore it has therefore been difficult to hold such cartridges solely on the radially inward side with a hook 52. As shown in FIG. 4 and FIG. 6, the cartridge receiving holes 30 are provided on the radially outward side with a radiused pocket 152, in which the cartridge rim 40 finds backing support.

I claim:

1. A quick-loading device for a revolver of the type having a revolver cylinder with a plurality of chambers comprising:

a cartridge holder having means for receiving and holding a plurality of cartridges and for simultaneously inserting the cartridges into the chambers of the revolvers and releasing the cartridges from said holder; and means for adjusting the position of the cartridges held by said cartridge holder whereby said cartridge holder is adaptable to accommodate revolvers having different chamber diameters.

2. The quick-loading device according to claim 1, wherein said means for adjusting comprises means for synchronously adjusting the position of the cartridges held by said cartridge holder.

3. The quick-loading device according to claim 1, wherein said means for adjusting comprises a screw mechanism.

4. The quick-loading device according to claim 1, additionally including means for locking said means for adjusting so that said holder is locked in a fixed, adjusted position.

5. The quick-loading device according to claim 1, wherein said means for adjusting changes the radial position of the cartridges held in the cartridge holder.

6. The quick-loading device according to claim 1, wherein said means for adjusting changes the radial inclination of the cartridges held in the cartridge holder.

7. The quick-loading device according to claim 1, wherein said means for adjusting changes the radial position and inclination of the cartridges held in the cartridge holder.

8. The quick-loading device according to claim 4, wherein said means for receiving and holding the cartridges in said cartridge holder has a normal position in which the cartridges are held parallel to the direction of insertion into the revolver cylinder and an adjusted position in which the cartridges can be adjusted inwardly or outwardly and fixed in such position.

9. A quick-loading device according to claim 8, wherein said means for adjusting changes the radial position of the cartridges.

10. A quick-loading device according to claim 8, wherein said means for adjusting changes the radial inclination of the cartridges.

11. A quick-loading device according to claim 8, wherein said means for adjusting changes the radial position and inclination of the cartridges.

12. A quick-loading device according to claim 1, wherein said cartridge holder comprises a housing with a collar of receiving holes for receiving cartridges each having a cartridge case and rim, wherein each cartridge is held in the receiving hole by a hook that engages with the cartridge rim and bears on the cartridge case, and wherein the position of the hooks can be changed and fixed during adjustment.

13. A quick-loading device according to claim 12, wherein the radial position of the hooks can be changed and fixed during adjustment.

14. A quick-loading device according to claim 12, wherein the radial inclination of the hooks can be changed and fixed during adjustment.

15. A quick-loading device according to claim 12, wherein the radial position and inclination of the hooks can be changed and fixed during adjustment.

16. The quick-loading device according to claim 12, wherein said means for adjusting comprises means for synchronously adjusting the position of the cartridges held by said cartridge holder.

17. A quick-loading device according to claim 12, wherein said hook is made from a member selected from the group consisting of wear-resistant plastic and hard metal.

18. A quick-loading device according to claim 12, wherein at least a portion of the hook that engages with the cartridge rim is made of a member selected from the group consisting of wear-resistant plastic and hard metal.

19. A quick-loading device according to claim 12, wherein the portion of the hook engaging with the cartridge rim is provided with a facing made of a member selected from the group consisting of wear-resistant plastic and hard metal.

20. A quick-loading device according to claim 12, wherein said hook has a portion bearing on the cartridge case which has a channel into which the cartridge fits.

21. A quick-loading device according to claim 12, wherein the hooks while in holding position each rest on a ramp, and in that adjustment takes place by positioning the hooks along the ramp.

22. A quick-loading device according to claim 12, wherein the hooks while in holding position rest on a ramp, and in that adjustment takes place by positioning the ramp along the hooks.

23. A quick-loading device according to claim 21, wherein said hooks are held against the ramp by springs.

24. A quick-loading device according to claim 21, wherein said hooks are disengaged from the cartridge rim and the cartridges are released by positioning the hooks along the ramp.

25. A quick-loading device according to claim 21, wherein said hooks are disengaged from the cartridge rim and the cartridges are released by positioning the ramp along the hooks.

26. A quick-loading device according to claim 21, wherein said ramp has one gently inclined portion and one steep portion, and wherein adjustment of the hooks takes place on the gently inclined ramp portion and disengagement of the hooks takes place on the steep ramp portion.

27. A quick-loading device according to claim 21, wherein the hooks hold the cartridges at the radially inward side, wherein the ramps are disposed on the radially inward side of the hooks and wherein inside the ramp collar there is provided a ram which during loading impinges on the axis of the revolver cylinder and drives into the housing to release the cartridges.

28. A quick-loading device according to claim 21, wherein the ramps are disposed integrally with the housing, and are secured against rotation in the housing, and wherein the ram also drags along the hooks.

29. A quick-loading device according to claim 28, additionally including a guide ring holding the hooks and wherein said ram also drags along said guide ring holding the hooks.

30. A quick-loading device according to claim 21, wherein the hooks are braced against the rear end of the ram and can be adjusted by adapting the ram length.

31. A quick-loading device according to claim 21, wherein the hooks are pivoted around their radially inward side at the rear end of the ram.

32. A quick-loading device according to claim 21, wherein the hooks are fixed in orientation at their rear end by an external guide shoulder and are otherwise unconstrained at the radially outward side.

33. A quick-loading device according to claim 21, wherein the ram comprises a threaded bushing which is held in such a way that it is secured against rotation relative to the housing but is axially positionable therealong, an adjusting screw which is screwed into the threaded bushing and against which the hooks are braced, and a locking arrangement for the adjusting screw.

34. A quick-loading device according to claim 33, additionally including a guide ring holding the hooks and wherein said threaded bushing is structurally joined with said guide ring.

35. A quick-loading device according to claim 33, wherein the locking arrangement comprises a locking screw screwed into the threaded bushing thus jamming the adjusting screw.

36. A quick-loading device according to claim 33, wherein the locking arrangement comprises a polygonal guide for the adjusting screw.

37. A quick-loading device according to claim 12, wherein the cartridge receiving holes are provided on the side opposite the hook with a radiused pocket.

38. A quick-loading device according to claim 1, additionally including means for blocking release of the cartridges.

39. A quick-loading device according to claim 38, additionally including means for locking said means for blocking.

40. A quick-loading device according to claim 38, wherein the driving-in movement of the ram into the housing can be blocked and released with said means for blocking which comprises a positionable stop, and said means for locking comprises a lock and key which operates said positionable stop.

* * * * *